US011143471B1

(12) United States Patent
Lee et al.

(10) Patent No.: US 11,143,471 B1
(45) Date of Patent: Oct. 12, 2021

(54) INTEGRATED SHELL DEFLECTOR FORWARD ASSIST FOR FIREARMS

(71) Applicant: Strike Industries, Inc., Santa Ana, CA (US)

(72) Inventors: Shanyao Lee, Santa Ana, CA (US); Chienyuan Cheng, Santa Ana, CA (US)

(73) Assignee: Strike Industries, Inc., Santa Ana, CA (US)

( * ) Notice: Subject to any disclaimer, the term of this patent is extended or adjusted under 35 U.S.C. 154(b) by 0 days.

(21) Appl. No.: 16/904,239

(22) Filed: Jun. 17, 2020

(51) Int. Cl.
*F41A 9/55* (2006.01)
*F41A 3/66* (2006.01)

(52) U.S. Cl.
CPC . *F41A 9/55* (2013.01); *F41A 3/66* (2013.01)

(58) Field of Classification Search
CPC ..... F41A 9/55; F41A 3/66
See application file for complete search history.

(56) References Cited

U.S. PATENT DOCUMENTS 2,355,769 A * 8/1944 Williams ..... F41A 3/26 42/25
3,270,617 A * 9/1966 Seymour ..... F41A 9/60 89/33.4
3,603,015 A * 9/1971 Jensen ..... F41A 9/60 42/98
3,733,728 A * 5/1973 Kuslich ..... F41A 9/60 42/98
4,621,444 A * 11/1986 Anderson ..... F41A 9/56 42/98
5,900,577 A * 5/1999 Robinson ..... F41A 11/02 89/191.01
6,487,808 B1 * 12/2002 Carey ..... F41A 9/60 42/98
7,389,605 B1 * 6/2008 Clark ..... F41A 9/60 42/98
8,567,301 B1 * 10/2013 Sharron ..... F41A 3/72 89/1.4
8,910,406 B1 * 12/2014 Huang ..... F41A 3/66 42/16
9,664,468 B1 * 5/2017 Johnson ..... F41A 15/16
10,132,580 B1 * 11/2018 Kincel ..... F41A 7/00
10,563,939 B1 * 2/2020 Oglesby ..... F41A 3/38
2010/0000396 A1 * 1/2010 Brown ..... F41A 3/72 89/1.4
2010/0212201 A1 * 8/2010 Kincel ..... F41G 11/003 42/2
2011/0083551 A1 * 4/2011 Sirochman ..... F41A 7/00 89/191.01
2012/0174451 A1 * 7/2012 Overstreet ..... F41A 35/06 42/16

(Continued)

*Primary Examiner* — Derrick R Morgan
(74) *Attorney, Agent, or Firm* — Han IP PLLC; Andy M. Han

(57) ABSTRACT

A device is movably attachable to an upper receiver of a firearm adjacent to a rear end of an ejection port on the upper receiver. The device is configured to move linearly in directions parallel to a longitudinal axis of the upper receiver to function as a forward assist to cause a bolt carrier of the firearm to move forward with respect to the upper receiver. The device comprises a shell deflector having a deflection surface configured to deflect spent casings ejected out of the ejection port when the firearm is in operation.

18 Claims, 9 Drawing Sheets

(56) References Cited

U.S. PATENT DOCUMENTS

| | | | | |
|---|---|---|---|---|
| 2013/0061737 | A1* | 3/2013 | Brown | F41A 3/72 89/1.4 |
| 2016/0047614 | A1* | 2/2016 | Larson, Jr. | F41A 3/72 89/191.01 |
| 2016/0209166 | A1* | 7/2016 | Larson, Jr. | F41G 1/033 |
| 2018/0356171 | A1* | 12/2018 | Brown | F41A 3/26 |
| 2019/0113295 | A1* | 4/2019 | Larish | F41A 35/06 |
| 2019/0331443 | A1* | 10/2019 | Brown | F41A 3/12 |
| 2019/0331446 | A1* | 10/2019 | Brown | F41A 11/02 |
| 2021/0102780 | A1* | 4/2021 | Senff | F41C 23/18 |

* cited by examiner

INTEGRATED SHELL DEFLECTOR FORWARD ASSIST FOR FIREARMS

TECHNICAL FIELD

The present disclosure is generally related to firearm accessories and, more particularly, to an integrated shell defector forward assist for firearms.

BACKGROUND

Unless otherwise indicated herein, approaches described in this section are not prior art to the claims listed below and are not admitted as prior art by inclusion in this section.

On certain types of firearms (e.g., firearms based on an AR platform such as AR15-styled or AR10-styled rifles, carbines, pistols and shotguns), an upper receiver of the firearm is typically equipped with two separate mechanical features, namely: a shell deflector and a forward assist. The shell deflector (also known as "brass deflector") is a mechanical feature or protrusion on the upper receiver near a rear end of an ejection port on the upper receiver. The shell deflector functions by deflecting spent casings or shells ejected out of the ejection port when ammunition cartridges are fired by the firearm. Without the shell deflector, it is possible that ejected casings/shells might hit the face of a user when firing rounds out of the firearm. On the other hand, the forward assist is typically a button located behind the shell deflector on the upper receiver. The forward assist is used to move a bolt or bolt carrier group of the firearm fully forward. The forward assist is useful when a return spring of the firearm does not properly return the bolt or bolt carrier group to its fully forward position. When pressed by the user, the forward assist pushes the bolt or bolt carrier forward to ensure that the bolt carrier group is closed and the bolt is locked.

However, as both the shell deflector and forward assist are located on the same side (e.g., right side) of the upper receiver where the ejection port is located, the upper receiver (as well as the firearm) as a whole tends to look uneven or imbalanced as there are no such features on the opposite side (e.g., left side) of the upper receiver. Besides, as the forward assist is located at the rear end of the upper receiver where a sling could be attached (e.g., to a lower receiver, an end plate or a buttstock), it is possible that the forward assist could interfere with the sling as well as usage/maneuvering of the firearm by the user.

SUMMARY

The following summary is illustrative only and is not intended to be limiting in any way. That is, the following summary is provided to introduce concepts, highlights, benefits and advantages of the novel and non-obvious techniques described herein. Select implementations are further described below in the detailed description. Thus, the following summary is not intended to identify essential features of the claimed subject matter, nor is it intended for use in determining the scope of the claimed subject matter.

In view of the aforementioned issues, an objective of the present disclosure is to propose an innovative design of an integrated shell deflector forward assist. It is believed that the proposed design can avoid or otherwise minimize aforementioned issues associated with conventional shell deflector and forward assist. Moreover, the integration of a forward assist and a shell deflector under the proposed design is believed to render the appearance of the upper receiver to be more sleek-looking in addition to providing the user more freedom and room in using the firearm as well as mounting accessories near the rear end of the upper receiver.

In one aspect, an apparatus implementable on a firearm may include an upper receiver and a device. The upper receiver may have a cavity therein and may be configured with a front opening, a rear opening opposite the front opening, a lower opening and an ejection port through which spent casings of ammunition cartridges are ejected when the firearm is in operation. The device may be movably attached to the upper receiver adjacent to a rear end of the ejection port to move linearly in directions parallel to a longitudinal axis of the upper receiver. The device may include a shell deflector having a deflection surface configured to deflect the spent casings ejected out of the ejection port.

In another aspect, an apparatus implementable on a firearm may include a device movably attachable to an upper receiver of the firearm adjacent to a rear end of an ejection port on the upper receiver. The device may be configured to move linearly in directions parallel to a longitudinal axis of the upper receiver to function as a forward assist to cause a bolt carrier of the firearm to move forward with respect to the upper receiver. The device may include a shell deflector having a deflection surface configured to deflect spent casings ejected out of the ejection port when the firearm is in operation.

BRIEF DESCRIPTION OF THE DRAWINGS

The accompanying drawings are included to provide a further understanding of the disclosure and are incorporated in and constitute a part of the present disclosure. The drawings illustrate implementations of the disclosure and, together with the description, explain the principles of the disclosure. It is appreciable that the drawings are not necessarily in scale as some components may be shown to be out of proportion than the size in actual implementation to clearly illustrate the concept of the present disclosure.

DETAILED DESCRIPTION OF PREFERRED IMPLEMENTATIONS

Figure 1:
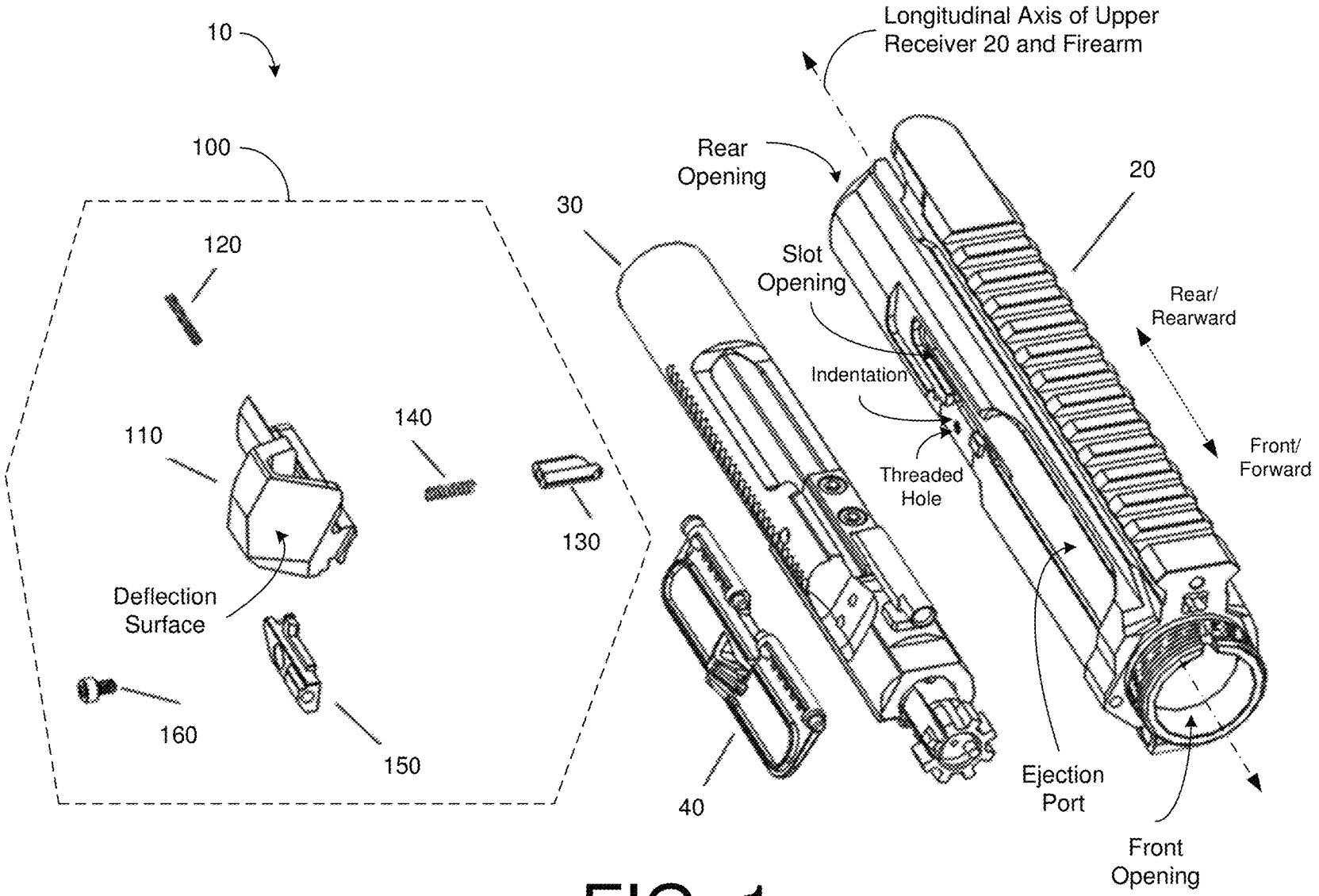
FIG. 1 is a diagram of an exploded view of an apparatus in accordance with an implementation of the present disclosure.

Detailed embodiments and implementations of the claimed subject matters are disclosed herein. However, it shall be understood that the disclosed embodiments and implementations are merely illustrative of the claimed subject matters which may be embodied in various forms. The present disclosure may, however, be embodied in many different forms and should not be construed as limited to the exemplary embodiments and implementations set forth herein. Rather, these exemplary embodiments and implementations are provided so that description of the present disclosure is thorough and complete and will fully convey the scope of the present disclosure to those skilled in the art. In the description below, details of well-known features and techniques may be omitted to avoid unnecessarily obscuring the presented embodiments and implementations.

The position terms used in the present disclosure, such as "front", "forward", "rear", "back", "top", "bottom", "left", "right", "head", "tail" or the like assume a firearm in the normal firing position, with the firearm being in a position in which the longitudinal axis of the barrel of the firearm runs generally horizontally and the direction of firing points "forward" away from the operator or user of the firearm. The same convention applies for the direction statements used herein.

As used herein, the terms "proximal" and "proximally" may denote "forward" and "forwardly" with respect to the firearm, and the terms "distal" and "distally" may denote "rearward" and "rearwardly" with respect to the firearm. As used herein, the verb "to comprise" in this description, claims, and other conjugations are used in its non-limiting sense to mean those items following the word are included, but items not specifically mentioned are not excluded. As used herein, the word "forward" means moving in the direction that the projectile moves during firing a firearm. As used herein, the word "proximal" means closer to the reference point, in this case, the shooter. As used herein, the word "distal" means farther to the reference point, in this case, the shooter. Reference to an element by the indefinite article "a" or "an" does not exclude the possibility that more than one of the elements are present, unless the context clearly requires that there is one and only one of the elements. The indefinite article "a" or "an" thus usually means "at least one." Additionally, the words "a" and "an" when used in the present document in concert with the words "comprising" or "containing" denote "one or more.

All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure. The recitation of numerical ranges by endpoints includes all numbers within that range (e.g. 1 to 5 includes 1, 1.5, 2, 2.75, 3, 3.80, 4, and 5). All dimensions given herein are by way of examples to better illustrate the present disclosure embodiments and shall not be construed to limit the dimensions of the present disclosure embodiments to the given numeric values.

Overview

FIG. 1 illustrates an exploded view of an apparatus 10 in accordance with an implementation of the present disclosure. Referring to FIG. 1, apparatus 10 may include an upper receiver 20, a bolt carrier group 30, a dust cover 40 and a device 100. Device 100 may include a shell deflector 110, a shell deflector return spring 120, a forward assist (FA) hook 130, a FA hook spring 140, a dust cover housing 150, and a dust cover housing screw 160. Apparatus 10 may be implementable on a firearm such as a firearm based on an AR platform such as an AR15-styled or an AR10-styled rifle, carbine, pistol or shotgun (not shown).

Under a proposed design in accordance with the present disclosure, device 100 may be movably attached to upper receiver 20. Upper receiver 20 may have a cavity therein and may be configured with a front opening (e.g., to receive a barrel of the firearm), a rear opening (e.g., to receive a buffer tube of the firearm), a lower opening (e.g., to receive/mate with a lower receiver of the firearm), and an ejection port through which spent casings/shells of fired ammunition cartridges may be ejected out of the firearm. In the interest of brevity and to avoid obscuring the figures, none of the barrel, butter tube, lower receiver and other components typically found on a firearm based on an AR platform, which is not relevant to the proposed design, is shown. Device 100 may be movably attached to upper receiver 20 adjacent to a rear end of the ejection port on upper receiver 20. When attached to or otherwise mounted on upper receiver 20, device 100 may be configured to move linearly in directions (e.g., forward and backward/rearward) parallel to a longitudinal axis of upper receiver 20 (which is also the longitudinal axis of the firearm) to function as a forward assist to cause a bolt carrier of bolt carrier group 30 of the firearm to move forward with respect to upper receiver 20. Device 100 may include a shell deflector 110 having a deflection surface configured to deflect spent casings ejected out of the ejection port when the firearm is in operation. In other words, device 100 may be considered an integrated shell deflector forward assist configured with the dual functions of shell deflector and forward assist.

Under the proposed design, shell deflector 110 may be linearly movable between an idle position and a forward position. When pressed forwardly with respect to upper receiver 20 by a user, shell deflector 110 may move from the idle position to the forward position with shell deflector return spring 120 compressed. When not pressed forwardly, shell deflector 110 may return to the idle position from the forward position by a first force exerted by shell deflector return spring 120. Upper receiver 20 may be configured with a slot opening extending rearwardly from the ejection port. Accordingly, shell deflector return spring 120 may be at least partially received in the slot opening.

Figure 2:
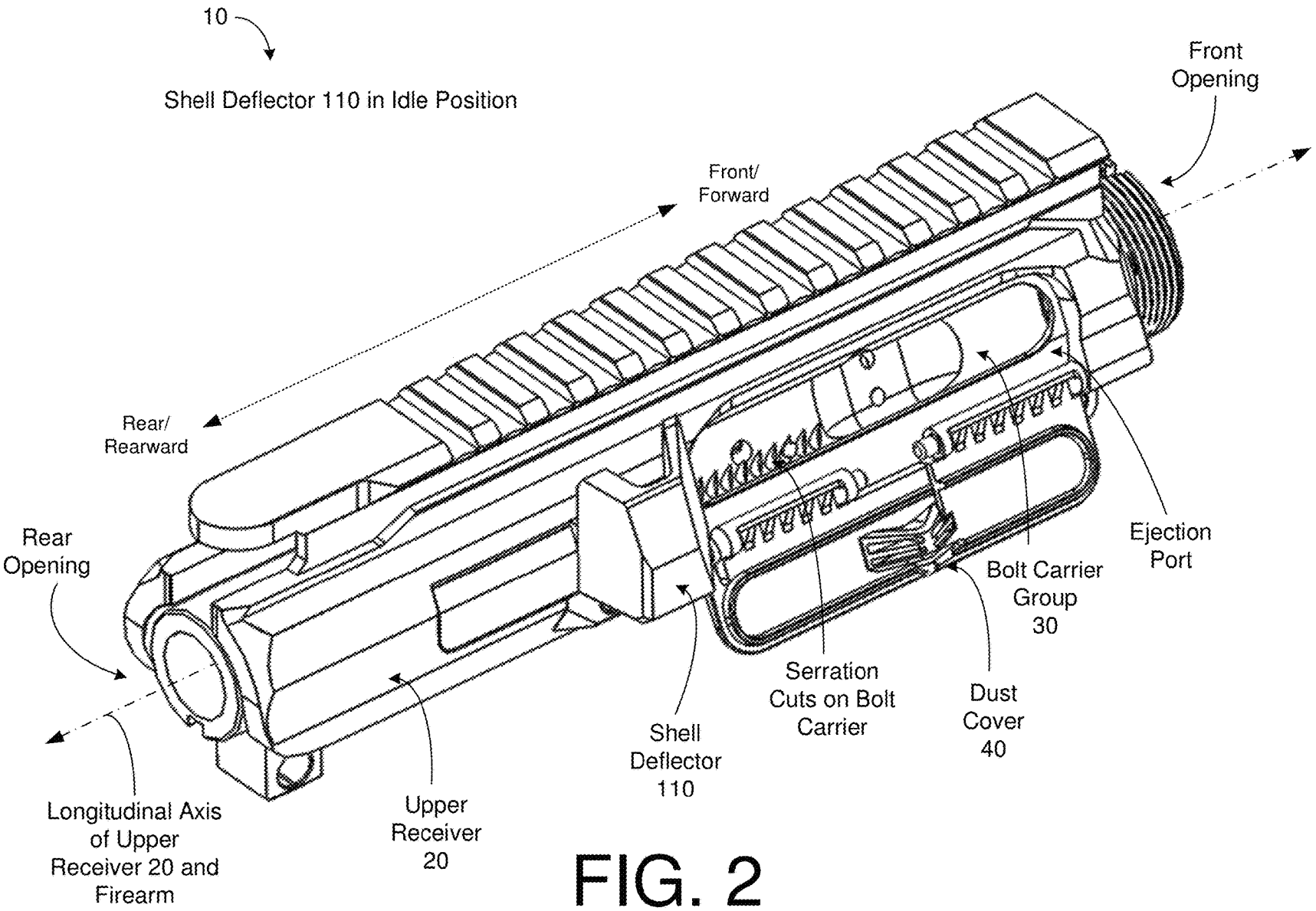
FIG. 2 is a diagram of an example scenario in accordance with an implementation of the present disclosure.
Figure 3:
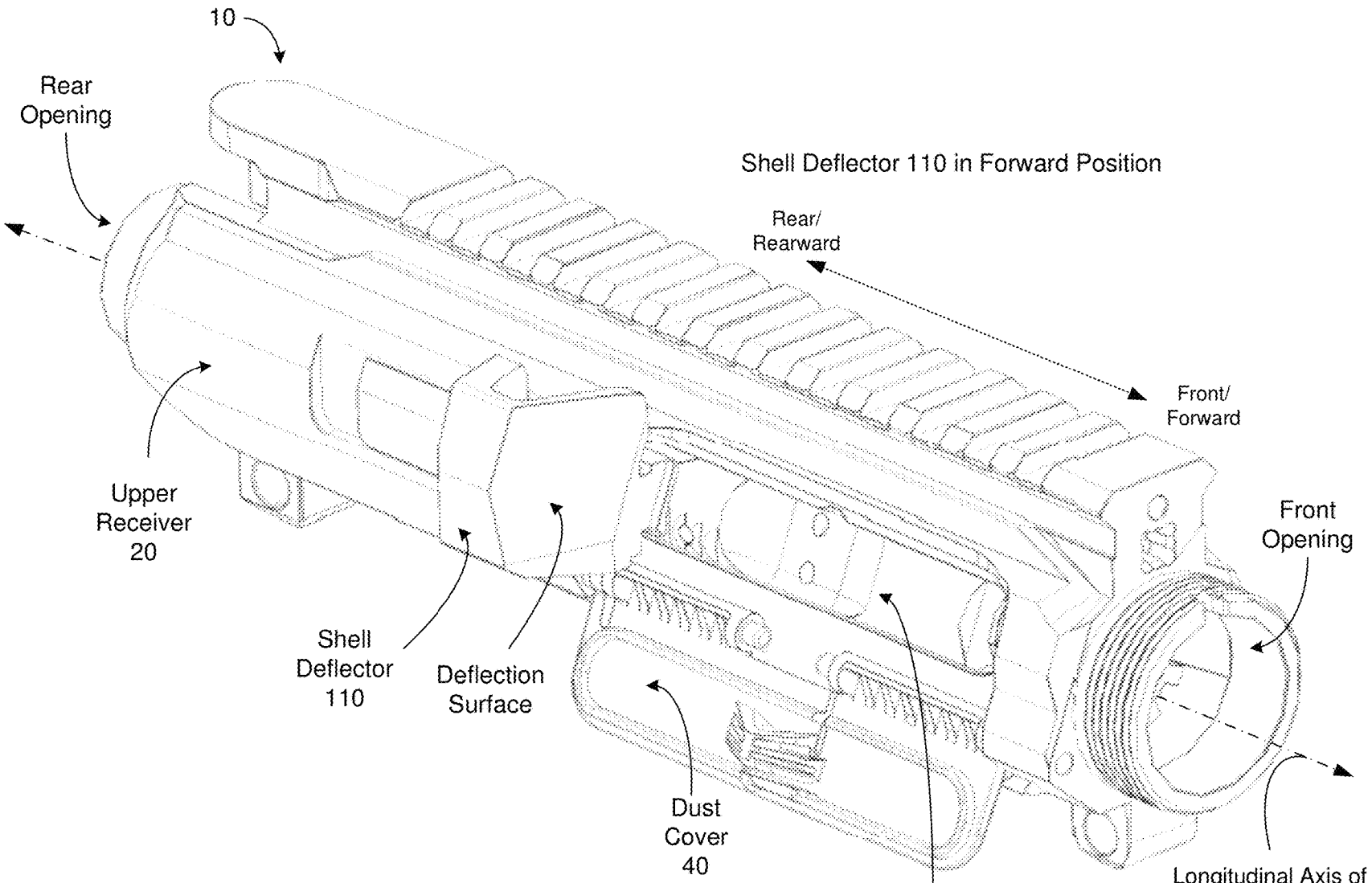
FIG. 3 is a diagram of an example scenario in accordance with an implementation of the present disclosure.
Figure 4:
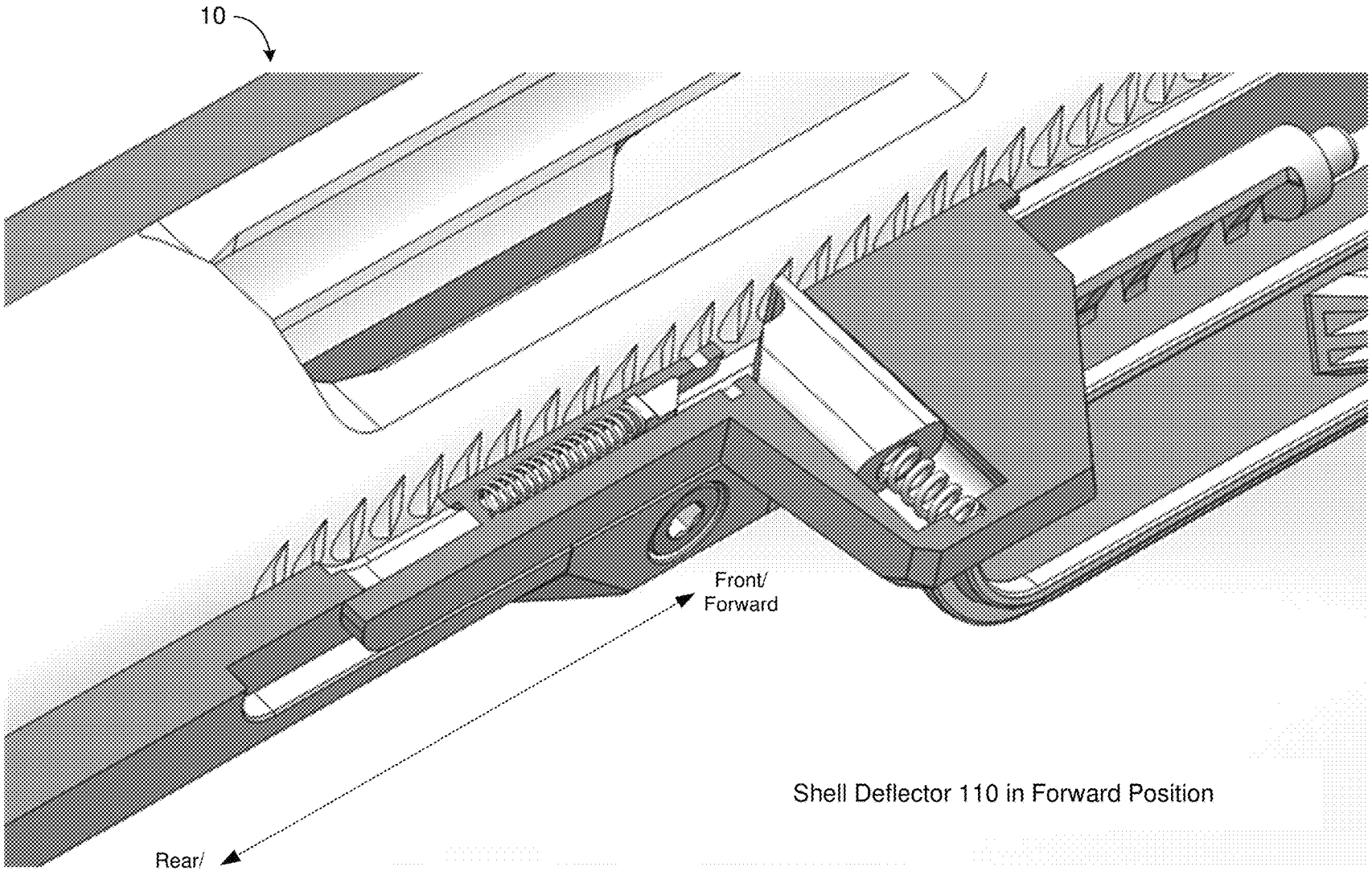
FIG. 4 is a diagram of a first cutaway view of an apparatus in accordance with an implementation of the present disclosure.
Figure 5:
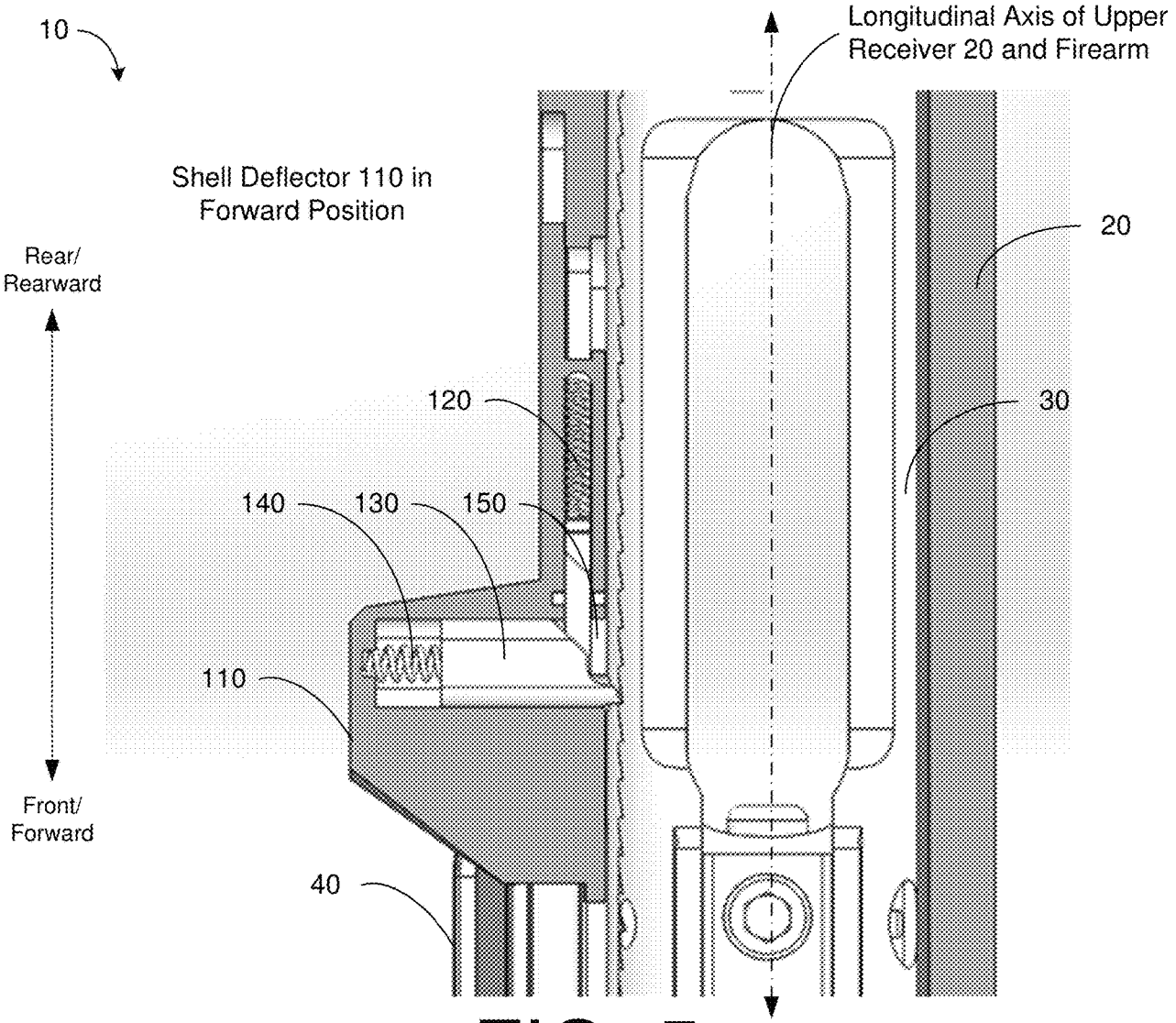
FIG. 5 is a diagram of a second cutaway view of an apparatus in accordance with an implementation of the present disclosure.
Figure 6:
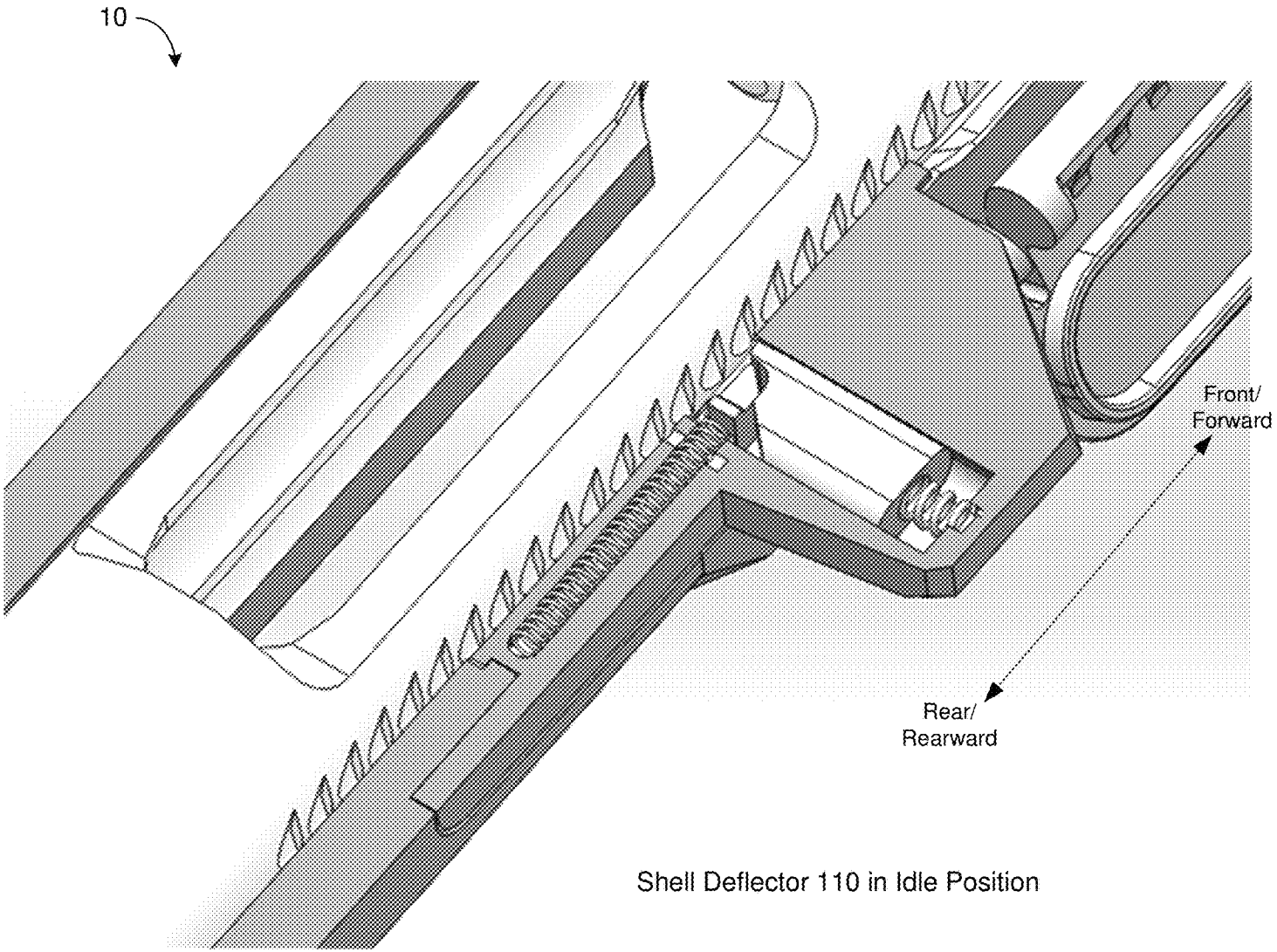
FIG. 6 is a diagram of a third cutaway view of an apparatus in accordance with an implementation of the present disclosure.
Figure 7:
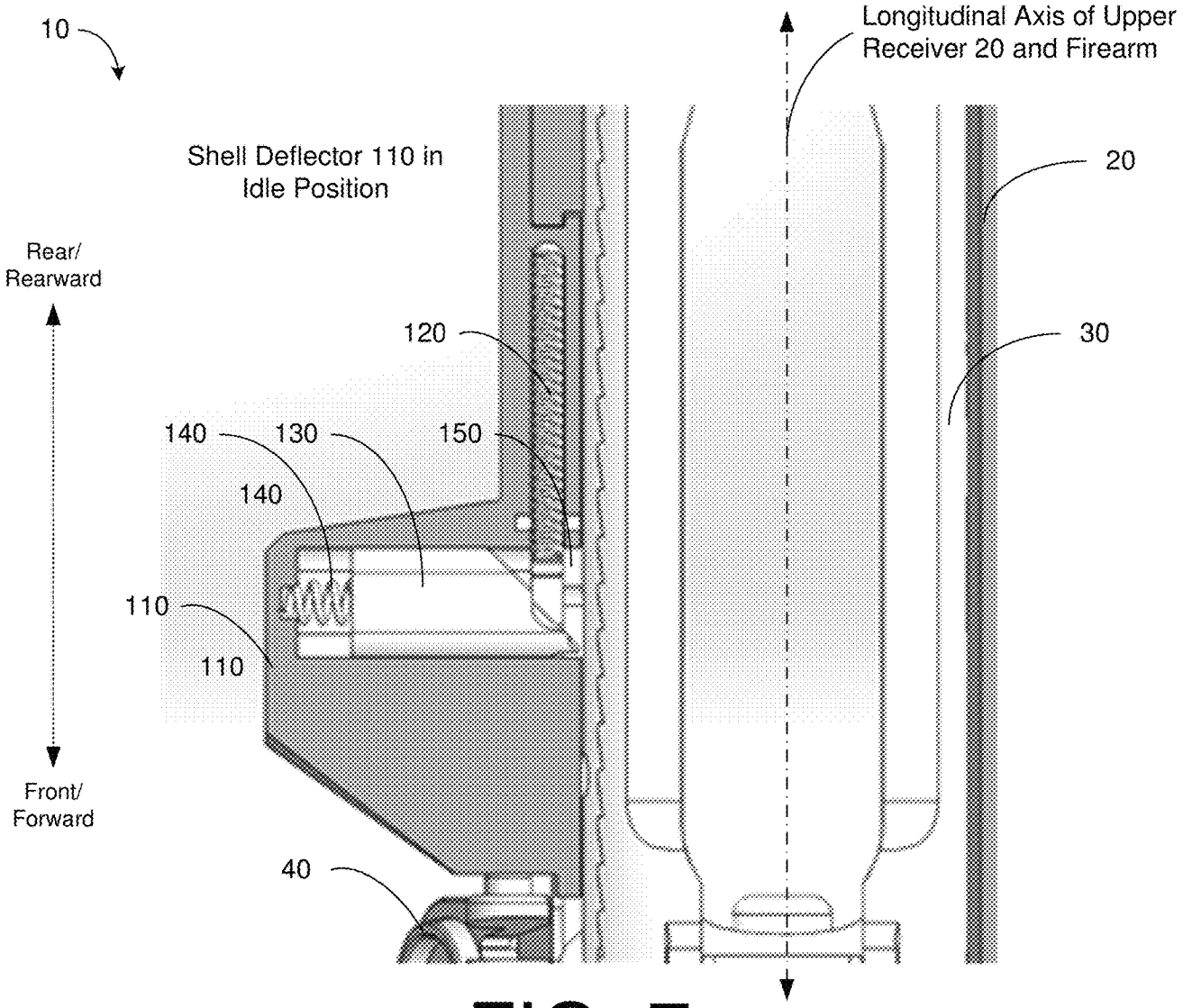
FIG. 7 is a diagram of a fourth cutaway view of an apparatus in accordance with an implementation of the present disclosure.

FIG. 2 illustrates an example scenario in accordance with an implementation of the present disclosure. In particular, FIG. 2 illustrates a scenario in which shell deflector 110 is in the idle position. FIG. 3 illustrates an example scenario in accordance with an implementation of the present disclosure. In particular, FIG. 3 illustrates a scenario in which shell deflector 110 is in the forward position. FIG. 4 illustrates a first cutaway view of apparatus 10 in accordance with an implementation of the present disclosure. In particular, FIG. 4 illustrates a scenario in which shell deflector 110 is in the forward position. FIG. 5 illustrates a second cutaway view of apparatus 10 in accordance with an implementation of the present disclosure. In particular, FIG. 5 illustrates a scenario in which shell deflector 110 is in the forward position. FIG. 6 illustrates a third cutaway view of apparatus 10 in accordance with an implementation of the present disclosure. In particular, FIG. 6 illustrates a scenario in which shell deflector 110 is in the idle position. FIG. 7 illustrates a fourth cutaway view of apparatus 10 in accordance with an implementation of the present disclosure. In particular, FIG. 7 illustrates a scenario in which shell deflector 110 is in the idle position.

Under the proposed design, shell deflector 110 may be configured with a cavity to receive FA hook spring 140 and FA hook 130 therein. Accordingly, FA hook 130 may be linearly movable between a retracted position and an engage position due to shell deflector 110 linearly moving between the idle position and the forward position and due to FA hook spring 140 exerting a second force on FA hook 130 in a direction toward and perpendicular to the longitudinal axis of upper receiver 20. Advantageously, when shell deflector 110 is moved from the idle position to the forward position by the user, FA hook 130 may move from the retracted position to the engaged position to cause a tip of FA hook 130 pointed toward upper receiver 20 to engage with a serration cut on a bolt carrier of bolt carrier group 30 to result in the bolt carrier (and hence bolt carrier group 30) moving forward with respect to upper receiver 20. Moreover, when shell deflector 110 is moved from the forward position to the idle position (e.g., when not pressed by the user and due to force exerted by shell deflector return spring 120), FA hook 130 may move from the engaged position to the retracted position to cause the tip of FA hook 130 disengage from the serration cut on the bolt carrier of the firearm.

Figure 8:
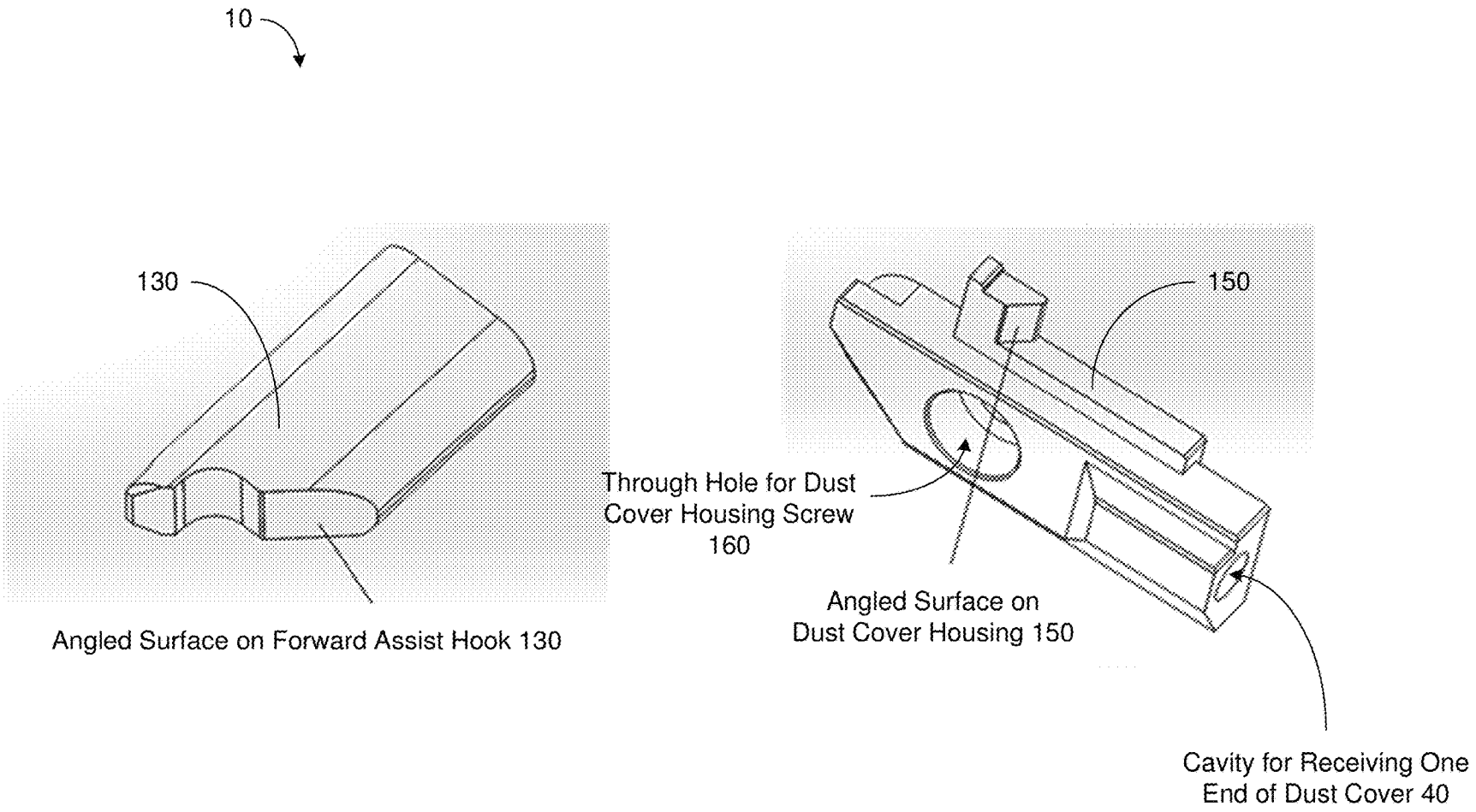
FIG. 8 is a diagram of various components of an apparatus in accordance with an implementation of the present disclosure.
Figure 9:
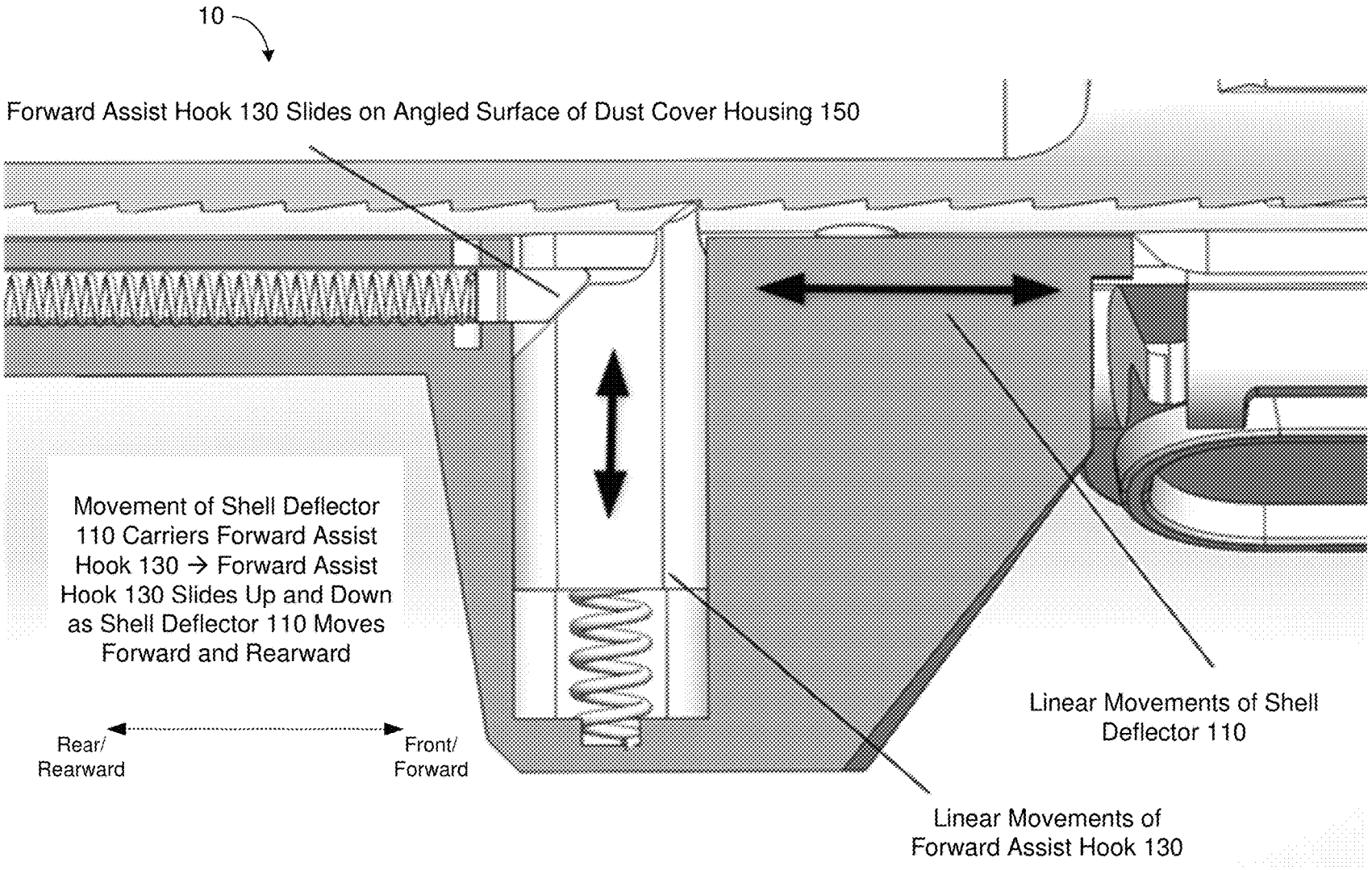
FIG. 9 is a diagram of an example scenario in accordance with an implementation of the present disclosure.

Under the proposed design, dust cover housing 150 may be attachable to upper receiver 20 near an rear end of the ejection port. Moreover, dust cover housing 150 may include a first angled surface. Correspondingly, FA hook 130 may include a second angled surface configured to slide over the first angled surface of dust cover housing 150 to result in operations including: (a) FA hook 130 moving from the retracted position to the engaged position responsive to shell deflector 110 moving from the idle position to the forward position, and (b) FA hook 130 moving from the engaged position to the retracted position responsive to shell deflector 110 moving from the forward position to the idle position. FIG. 8 illustrates various components of apparatus 10 in accordance with an implementation of the present disclosure. In particular, FIG. 8 illustrates the first angled surface on dust cover housing 150 and the second angled surface on FA hook 130. FIG. 9 illustrates an example scenario in accordance with an implementation of the present disclosure. Referring to FIG. 9, linear movement of shell deflector 110 carries FA hook 130 to cause FA hook 130 to slide up and down as shell deflector 110 moves forward (from the idle position to the forward position) and rearward (from the forward position to the idle position).

Under the proposed design, upper receiver 20 may have an indentation with a threaded hole therein. Moreover, dust cover housing 150 may have a through hole and, thus, dust cover housing 150 may be secured to upper receiver 20 with dust cover housing screw 160 traversing through the through hole and received in the threaded hole on upper receiver 20.

Under the proposed design, one end of dust cover 40 may be pivotably receivable in a cavity of dust cover housing 150, and dust cover 40 may be pivotable between a closed position and an open position. Accordingly, the ejection port may be covered by the dust cover responsive to dust cover 40 being in the closed position. Moreover, the ejection port may be not covered by the dust cover responsive to dust cover 40 being in the open position.

Under the proposed design, shell deflector 110 may be movable from the idle position to the forward position responsive to dust cover 40 being in the open position. Furthermore, shell deflector 110 may be in the idle position and prevented from moving to the forward position responsive to dust cover 40 being in the closed position.

In view of the above, it can be seen that device 100, or shell deflector 110 in particular, may only be moved forward when dust cover 40 is in its open position to prevent unnecessary movement of shell deflector 110 to cause damage to FA hook 130. In operation, when the user opens dust cover 40 and pushes shell deflector 110 forward, FA hook 130 is pushed from its retracted position toward the longitudinal axis of upper receiver 20 (and toward its engaged position) due to the forward movement of shell deflector 110 and due to the second angled surface of FA hook 130 sliding over the first angled surface of dust cover housing 150. This results in the tip of FA hook 130 engaging with one of a plurality of serration cuts on the bolt carrier of bolt carrier group 30, thereby dragging bolt carrier group 30 to move forward as shell deflector 110 is pushed forward by the user. Once the user ceases pushing forward and let go of shell deflector 110, shell deflector return spring 120 may exert a force to push shell deflector 110 backward or rearward. This will result in FA hook 130 sliding over the first angled surface of dust cover housing 150 to move to its retracted position to be disengaged from the bolt carrier of bolt carrier group 30.

In case that the user accidentally pushes shell deflector 110 while firing the firearm, the unique design of FA hook 130 allows it to be pushed back (to its retracted position) by the bolt carrier. When pushed back, FA hook 130 is retracted and thus is disengaged from any of the serration cuts of the bolt carrier due to the first angled surface on dust cover housing 150 which provides enough clearance for the bolt carrier to run through without damaging the system or the user. Moreover, shell deflector 110 would also be pushed backward or rearward to prevent it from interfering with ejection of spent casings/shells.

It is noteworthy that the dimensions of various components of the proposed design may be adjusted to suit actual implementations. For instance, the overall size may be enlarged for implementation on a firearm of the AR10 platform (e.g., one chambered in 308 Winchester or 7.62×51 mm NATO). Similarly, the overall style may be changed. Likewise, the overall size may be reduced for implementation on a firearm of the AR15 platform (e.g., one chambered in 0.223 Remington or 5.56×54 mm NATO). For instance, dust cover housing 150 may be replaced with one that has a same angled surface but has no cavity to receive dust cover 40. It is also noteworthy that, with suitable adjustment to one or more components, device 100 may be made suitable to serve as a bolt charging handle as an alternative or additional use/function. It is further noteworthy that each component of device 100 may be made of a suitable material (e.g., a suitable metal such as steel, aluminum or alloy) with appropriate mechanical properties such as sufficient strengths and/or hardness to withstand vibrations caused by firing of ammunition cartridges.

It is further noteworthy that term "AR platform" herein refers to firearms based on the AR15 platform and the AR10 platform, as well as any variation and derivative thereof, and include AR15-styled and AR10-styled firearms, including rifles, carbines, pistols and shotguns. A firearm based on an AR platform may be chambered in one of a plethora of calibers. Some of the more popular calibers include such as, for example and without limitation, 0.223 Remington, 5.56×54 mm NATO, 0.224 Valkyrie, 300 AAC Blackout, 7.62×39 mm, 458 SOCOM, 6.5 mm Grendel, 6.8 mm Remington SPC, 308 Winchester and 7.62×51 mm NATO, just to name a few. Accordingly, the proposed design in accordance with the present disclosure may be implemented in any firearm based on the AR platform (whether the AR15 platform or the AR10 platform), as well as any variation and derivative thereof, in any suitable caliber.

EXAMPLE IMPLEMENTATIONS

In view of the above, the proposed design of an integrated shell deflector forward assist may be implemented in many ways. For illustrative purposes and without limiting the scope of the present disclosure, a few example implementations of the proposed design are described below.

In one aspect, an apparatus (e.g., apparatus 10) implementable on a firearm based on an AR platform (e.g., AR15 platform or AR10 platform) may include an upper receiver and a device. The upper receiver may have a cavity therein and may be configured with a front opening, a rear opening opposite the front opening, a lower opening and an ejection port through which spent casings of ammunition cartridges are ejected when the firearm is in operation. The device may be movably attached to the upper receiver adjacent to a rear end of the ejection port to move linearly in directions parallel to a longitudinal axis of the upper receiver. The device may include a shell deflector having a deflection surface configured to deflect the spent casings ejected out of the ejection port.

In some implementations, the device may further include a return spring. In such cases, the shell deflector may be linearly movable between an idle position and a forward position. When pressed forwardly with respect to the upper receiver, the shell deflector may move from the idle position to the forward position with the return spring compressed. When not pressed forwardly, the shell deflector may return to the idle position from the forward position by a first force exerted by the return spring.

In some implementations, the upper receiver may be configured with a slot opening extending rearwardly from the ejection port. Moreover, the return spring may be at least partially received in the slot opening.

In some implementations, the device may further include a forward assist (FA) hook and a FA hook spring. Moreover, the shell deflector may be configured with a cavity to receive the FA hook spring and the FA hook therein. In such cases, the FA hook may be linearly movable between a retracted position and an engage position due to the shell deflector linearly moving between the idle position and the forward position and due to the FA hook spring exerting a second force on the FA hook in a direction toward and perpendicular to the longitudinal axis of the upper receiver.

In some implementations, when the shell deflector is moved from the idle position to the forward position, the FA hook may move from the retracted position to the engaged position to cause a tip of the FA hook pointed toward the upper receiver to engage with a serration cut on a bolt carrier of the firearm to result in the bolt carrier moving forward with respect to the upper receiver. In some implementations, when the shell deflector is moved from the forward position to the idle position, the FA hook may move from the engaged position to the retracted position to cause the tip of the FA hook disengage from the serration cut on the bolt carrier of the firearm.

In some implementations, the device may further include a dust cover housing attachable to the upper receiver near an rear end of the ejection port. Additionally, the dust cover housing may include a first angled surface. In such cases, the FA hook may include a second angled surface configured to slide over the first angled surface of the dust cover housing to result in operations including: (a) the FA hook moving from the retracted position to the engaged position responsive to the shell deflector moving from the idle position to the forward position, and (b) the FA hook moving from the engaged position to the retracted position responsive to the shell deflector moving from the forward position to the idle position.

In some implementations, the device may further include a dust cover housing screw. Moreover, the upper receiver may have an indentation with a threaded hole therein. In such cases, the dust cover housing may have a through hole and may be secured to the upper receiver with the dust cover housing screw traversing through the through hole and received in the threaded hole on the upper receiver.

In some implementations, the apparatus may further include a dust cover. In such cases, one end of the dust cover may be pivotably receivable in a cavity of the dust cover housing. Moreover, the dust cover may be pivotable between a closed position and an open position. The ejection port may be covered by the dust cover responsive to the dust cover being in the closed position, and the ejection port may be not covered by the dust cover responsive to the dust cover being in the open position.

In some implementations, the shell deflector may be movable from the idle position to the forward position responsive to the dust cover being in the open position. Furthermore, the shell deflector may be in the idle position and prevented from moving to the forward position responsive to the dust cover being in the closed position.

In another aspect, an apparatus (e.g., apparatus 10) implementable on a firearm based on an AR platform (e.g., AR15 platform or AR10 platform) may include a device movably attachable to an upper receiver of the firearm adjacent to a rear end of an ejection port on the upper receiver. The device may be configured to move linearly in directions parallel to a longitudinal axis of the upper receiver to function as a forward assist to cause a bolt carrier of the firearm to move forward with respect to the upper receiver. The device may include a shell deflector having a deflection surface configured to deflect spent casings ejected out of the ejection port when the firearm is in operation.

In some implementations, the device may further include a return spring. Moreover, the shell deflector may be linearly movable between an idle position and a forward position. When pressed forwardly with respect to the upper receiver, the shell deflector may move from the idle position to the forward position with the return spring compressed. When not pressed forwardly, the shell deflector may return to the idle position from the forward position by a first force exerted by the return spring.

In some implementations, the apparatus may further include the upper receiver which has a cavity therein. The upper receiver may be configured with a front opening, a rear opening opposite the front opening, a lower opening and an ejection port. Moreover, the upper receiver may be configured with a slot opening extending rearwardly from the ejection port. In such cases, the return spring may be at least partially received in the slot opening.

In some implementations, the device may further include a forward assist (FA) hook and a FA hook spring. Additionally, the shell deflector may be configured with a cavity to receive the FA hook spring and the FA hook therein. In such cases, the FA hook may be linearly movable between a retracted position and an engage position due to the shell deflector linearly moving between the idle position and the forward position and due to the FA hook spring exerting a second force on the FA hook in a direction toward and perpendicular to the longitudinal axis of the upper receiver.

In some implementations, when the shell deflector is moved from the idle position to the forward position, the FA hook may move from the retracted position to the engaged position to cause a tip of the FA hook pointed toward the upper receiver to engage with a serration cut on the bolt carrier to result in the bolt carrier moving forward with respect to the upper receiver. In some implementations, when the shell deflector is moved from the forward position to the idle position, the FA hook may move from the engaged position to the retracted position to cause the tip of the FA hook disengage from the serration cut on the bolt carrier of the firearm.

In some implementations, the device may further include a dust cover housing attachable to the upper receiver near an rear end of the ejection port. Moreover, the dust cover housing may include a first angled surface. In such cases, the FA hook may include a second angled surface configured to slide over the first angled surface of the dust cover housing to result in operations including: (a) the FA hook moving from the retracted position to the engaged position responsive to the shell deflector moving from the idle position to the forward position, and (b) the FA hook moving from the engaged position to the retracted position responsive to the shell deflector moving from the forward position to the idle position.

In some implementations, the device may further include a dust cover housing screw. Additionally, the upper receiver may have an indentation with a threaded hole therein. In such cases, the dust cover housing may have a through hole and may be secured to the upper receiver with the dust cover housing screw traversing through the through hole and received in the threaded hole on the upper receiver.

In some implementations, the apparatus may further include a dust cover. In such cases, one end of the dust cover may be pivotably receivable in a cavity of the dust cover housing. Additionally, the dust cover may be pivotable between a closed position and an open position. Furthermore, the ejection port may be covered by the dust cover responsive to the dust cover being in the closed position. Moreover, the ejection port may be not covered by the dust cover responsive to the dust cover being in the open position.

In some implementations, the shell deflector may be movable from the idle position to the forward position responsive to the dust cover being in the open position. Furthermore, the shell deflector may be in the idle position and prevented from moving to the forward position responsive to the dust cover being in the closed position.

Additional Notes

The herein-described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

Further, with respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

Moreover, it will be understood by those skilled in the art that, in general, terms used herein, and especially in the appended claims, e.g., bodies of the appended claims, are generally intended as "open" terms, e.g., the term "including" should be interpreted as "including but not limited to," the term "having" should be interpreted as "having at least," the term "includes" should be interpreted as "includes but is not limited to," etc. It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to implementations containing only one such recitation, even when the same claim includes the introductory phrases "one or more" or "at least one" and indefinite articles such as "a" or "an," e.g., "a" and/or "an" should be interpreted to mean "at least one" or "one or more;" the same holds true for the use of definite articles used to introduce claim recitations. In addition, even if a specific number of an introduced claim recitation is explicitly recited, those skilled in the art will recognize that such recitation should be interpreted to mean at least the recited number, e.g., the bare recitation of "two recitations," without other modifiers, means at least two recitations, or two or more recitations. Furthermore, in those instances where a convention analogous to "at least one of A, B, and C, etc." is used, in general such a construction is intended in the sense one having skill in the art would understand the convention, e.g., "a system having at least one of A, B, and C" would include but not be limited to systems that have A alone, B alone, C alone, A and B together, A and C together, B and C together, and/or A, B, and C together, etc. In those instances where a convention analogous to "at least one of A, B, or C, etc." is used, in general such a construction is intended in the sense one having skill in the art would understand the convention, e.g., "a system having at least one of A, B, or C" would include but not be limited to systems that have A alone, B alone, C alone, A and B together, A and C together, B and C together, and/or A, B, and C together, etc. It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

From the foregoing, it will be appreciated that various implementations of the present disclosure have been described herein for purposes of illustration, and that various modifications may be made without departing from the scope and spirit of the present disclosure. Accordingly, the various implementations disclosed herein are not intended to be limiting, with the true scope and spirit being indicated by the following claims.

What is claimed is:

1. An apparatus implementable on a firearm, comprising:

an upper receiver having a cavity therein and configured with at least an ejection port through which spent casings of ammunition cartridges are ejected when the firearm is in operation;

a device movably attached to the upper receiver adjacent to a rear end of the ejection port to move linearly in directions parallel to a longitudinal axis of the upper receiver, the device comprises a shell deflector having a deflection surface configured to deflect the spent casings ejected out of the ejection port; and wherein the device further comprises a return spring, wherein the shell deflector is linearly movable between an idle position and a forward position, wherein, when pressed forwardly with respect to the upper receiver, the shell deflector moves from the idle position to the forward position with the return spring compressed, and wherein, when not pressed forwardly, the shell deflector returns to the idle position from the forward position by a first force exerted by the return spring.

2. The apparatus of claim 1, wherein the upper receiver is configured with a slot opening extending rearwardly from the ejection port, and wherein the return spring is at least partially received in the slot opening.

3. The apparatus of claim 1, wherein the device further comprises a forward assist (FA) hook and a FA hook spring, wherein the shell deflector is configured with a cavity to receive the FA hook spring and the FA hook therein, and wherein the FA hook is linearly movable between a retracted position and an engage position due to the shell deflector linearly moving between the idle position and the forward position and due to the FA hook spring exerting a second force on the FA hook in a direction toward and perpendicular to the longitudinal axis of the upper receiver.

4. The apparatus of claim 3, wherein, when the shell deflector is moved from the idle position to the forward position, the FA hook moves from the retracted position to the engaged position to cause a tip of the FA hook pointed toward the upper receiver to engage with a serration cut on a bolt carrier of the firearm to result in the bolt carrier moving forward with respect to the upper receiver.

5. The apparatus of claim 4, wherein, when the shell deflector is moved from the forward position to the idle position, the FA hook moves from the engaged position to the retracted position to cause the tip of the FA hook disengage from the serration cut on the bolt carrier of the firearm.

6. The apparatus of claim 3, wherein the device further comprises a dust cover housing attachable to the upper receiver near an rear end of the ejection port, wherein the dust cover housing comprises a first angled surface, and wherein the FA hook comprises a second angled surface configured to slide over the first angled surface of the dust cover housing to result in operations comprising:

the FA hook moving from the retracted position to the engaged position responsive to the shell deflector moving from the idle position to the forward position, and the FA hook moving from the engaged position to the retracted position responsive to the shell deflector moving from the forward position to the idle position.

7. The apparatus of claim 6, wherein the device further comprises a dust cover housing screw, wherein the upper receiver has an indentation with a threaded hole therein, and wherein the dust cover housing has a through hole and is secured to the upper receiver with the dust cover housing screw traversing through the through hole and received in the threaded hole on the upper receiver.

8. The apparatus of claim 3, further comprising:

a dust cover, wherein one end of the dust cover is pivotably receivable in a cavity of the dust cover housing, wherein the dust cover is pivotable between a closed position and an open position, wherein the ejection port is covered by the dust cover responsive to the dust cover being in the closed position, and wherein the ejection port is not covered by the dust cover responsive to the dust cover being in the open position.

9. The apparatus of claim 8, wherein the shell deflector is movable from the idle position to the forward position responsive to the dust cover being in the open position, and wherein the shell deflector is in the idle position and prevented from moving to the forward position responsive to the dust cover being in the closed position.

10. An apparatus implementable on a firearm, comprising:

a device movably attachable to an upper receiver of the firearm adjacent to a rear end of an ejection port on the upper receiver, the device configured to move linearly in directions parallel to a longitudinal axis of the upper receiver to function as a forward assist to cause a bolt carrier of the firearm to move forward with respect to the upper receiver, the device comprises a shell deflector having a deflection surface configured to deflect spent casings ejected out of the ejection port when the firearm is in operation; and wherein the device further comprises a return spring, wherein the shell deflector is linearly movable between an idle position and a forward position, wherein, when pressed forwardly with respect to the upper receiver, the shell deflector moves from the idle position to the forward position with the return spring compressed, and wherein, when not pressed forwardly, the shell deflector returns to the idle position from the forward position by a first force exerted by the return spring.

11. The apparatus of claim 10, further comprising:

the upper receiver which has a cavity therein, the upper receiver configured with a front opening, a rear opening opposite the front opening, a lower opening and an ejection port, wherein the upper receiver is configured with a slot opening extending rearwardly from the ejection port, and wherein the return spring is at least partially received in the slot opening.

12. The apparatus of claim 10, wherein the device further comprises a forward assist (FA) hook and a FA hook spring, wherein the shell deflector is configured with a cavity to receive the FA hook spring and the FA hook therein, and wherein the FA hook is linearly movable between a retracted position and an engage position due to the shell deflector linearly moving between the idle position and the forward position and due to the FA hook spring exerting a second force on the FA hook in a direction toward and perpendicular to the longitudinal axis of the upper receiver.

13. The apparatus of claim 12, wherein, when the shell deflector is moved from the idle position to the forward position, the FA hook moves from the retracted position to the engaged position to cause a tip of the FA hook pointed toward the upper receiver to engage with a serration cut on the bolt carrier to result in the bolt carrier moving forward with respect to the upper receiver.

14. The apparatus of claim 13, wherein, when the shell deflector is moved from the forward position to the idle position, the FA hook moves from the engaged position to the retracted position to cause the tip of the FA hook disengage from the serration cut on the bolt carrier of the firearm.

15. The apparatus of claim 12, wherein the device further comprises a dust cover housing attachable to the upper receiver near an rear end of the ejection port, wherein the dust cover housing comprises a first angled surface, and wherein the FA hook comprises a second angled surface configured to slide over the first angled surface of the dust cover housing to result in operations comprising:

the FA hook moving from the retracted position to the engaged position responsive to the shell deflector moving from the idle position to the forward position, and the FA hook moving from the engaged position to the retracted position responsive to the shell deflector moving from the forward position to the idle position.

16. The apparatus of claim 15, wherein the device further comprises a dust cover housing screw, wherein the upper receiver has an indentation with a threaded hole therein, and wherein the dust cover housing has a through hole and is secured to the upper receiver with the dust cover housing screw traversing through the through hole and received in the threaded hole on the upper receiver.

17. The apparatus of claim 12, further comprising:

a dust cover, wherein one end of the dust cover is pivotably receivable in a cavity of the dust cover housing, wherein the dust cover is pivotable between a closed position and an open position, wherein the ejection port is covered by the dust cover responsive to the dust cover being in the closed position, and wherein the ejection port is not covered by the dust cover responsive to the dust cover being in the open position.

18. The apparatus of claim 17, wherein the shell deflector is movable from the idle position to the forward position responsive to the dust cover being in the open position, and wherein the shell deflector is in the idle position and prevented from moving to the forward position responsive to the dust cover being in the closed position.

* * * * *